US009121636B2

(12) United States Patent
Mock et al.

(10) Patent No.: US 9,121,636 B2
(45) Date of Patent: Sep. 1, 2015

(54) CONTAMINANT REMOVAL SYSTEM FOR CLOSED-LOOP REFRIGERATION CYCLES OF AN LNG FACILITY

(75) Inventors: Jon M. Mock, Katy, TX (US); Weldon L. Ransbarger, Houston, TX (US); James D. Ortego, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 1808 days.

(21) Appl. No.: 11/560,598

(22) Filed: Nov. 16, 2006

(65) Prior Publication Data

US 2008/0115530 A1 May 22, 2008

(51) Int. Cl.
*F25J 1/00* (2006.01)
*F25J 1/02* (2006.01)

(52) U.S. Cl.
CPC ..... *F25J 1/0249* (2013.01); *F25J 1/004* (2013.01); *F25J 1/0022* (2013.01); *F25J 1/0052* (2013.01); *F25J 1/0085* (2013.01); *F25J 1/0087* (2013.01); *F25J 1/021* (2013.01); *F25J 1/025* (2013.01); *F25J 1/0207* (2013.01); *F25J 2220/64* (2013.01); *F25J 2270/902* (2013.01)

(58) Field of Classification Search
CPC ..... F25B 43/02; F25B 43/04; F25B 43/043; F25J 1/0249; F25J 1/025; F25J 2270/902
USPC ..... 62/612, 475, 85, 77, 474, 195
See application file for complete search history.

(56) References Cited

U.S. PATENT DOCUMENTS

| | | | | | |
|---|---|---|---|---|---|
| 2,127,004 | A | * | 8/1938 | Nelson | 62/623 |
| 2,534,274 | A | * | 12/1950 | Ludwig | 62/628 |
| 2,551,666 | A | * | 5/1951 | Gilmore | 62/85 |
| 3,274,102 | A | * | 9/1966 | Brazell et al. | 208/341 |
| 3,440,828 | A | * | 4/1969 | Pryor et al. | 62/612 |
| 3,478,529 | A | * | 11/1969 | Boykin | 62/85 |
| 3,739,945 | A | * | 6/1973 | Moore et al. | 222/129 |
| 3,929,438 | A | * | 12/1975 | Harper et al. | 62/612 |
| 4,094,655 | A | * | 6/1978 | Krieger | 62/612 |
| 4,495,035 | A | * | 1/1985 | Swearingen | 203/23 |
| 5,060,481 | A | | 10/1991 | Bartlett et al. | |
| 5,189,889 | A | | 3/1993 | Daily | |
| 5,377,499 | A | | 1/1995 | Zugibe | |
| 5,379,607 | A | * | 1/1995 | Sergius | 62/126 |
| 5,473,900 | A | * | 12/1995 | Low | 62/611 |
| 5,535,596 | A | * | 7/1996 | Todack | 62/85 |
| 5,617,739 | A | | 4/1997 | Little | |
| 5,669,234 | A | * | 9/1997 | Houser et al. | 62/612 |
| 5,943,867 | A | * | 8/1999 | Thomas et al. | 62/85 |
| 5,956,971 | A | | 9/1999 | Cole et al. | |
| 6,053,007 | A | | 4/2000 | Victory et al. | |
| 6,357,240 | B1 | | 3/2002 | Zugibe et al. | |
| 6,415,628 | B1 | | 7/2002 | Ahmed et al. | |
| 6,425,264 | B1 | | 7/2002 | Wong et al. | |

* cited by examiner

*Primary Examiner* — John F Pettitt
(74) *Attorney, Agent, or Firm* — ConocoPhillips Company

(57) ABSTRACT

A system for removing a contaminant from a refrigerant stream employed in a closed-loop refrigeration cycle of an LNG facility. The system employs a distillation column to separate the refrigerant stream into a contaminant-rich and a contaminant-depleted stream, wherein the contaminant-depleted stream is subsequently returned to the closed-loop refrigeration cycle. The distillation column can include a reboiler and/or condenser. The reboiler and condenser can utilize one or more process streams from within the LNG facility to provide heating and/or cooling to the distillation column.

8 Claims, 3 Drawing Sheets

CONTAMINANT REMOVAL SYSTEM FOR CLOSED-LOOP REFRIGERATION CYCLES OF AN LNG FACILITY

BACKGROUND OF THE INVENTION

1. Field of the Invention

This invention relates to a method for liquefying natural gas. In another aspect, the invention concerns a method and apparatus for removing a contaminant from a closed-loop refrigeration cycle employed in a liquefied natural gas (LNG) facility.

2. Description of the Prior Art

The cryogenic liquefaction of natural gas is routinely practiced as a means of converting natural gas into a more convenient form for transportation and/or storage. Generally, liquefaction of natural gas reduces its volume by about 600-fold, thereby resulting in a liquefied product that can be readily stored and transported at near atmospheric pressure.

Natural gas is frequently transported by pipeline from the supply source to a distant market. It is desirable to operate the pipeline under a substantially constant and high load factor, but often the deliverability or capacity of the pipeline will exceed demand while at other times the demand will exceed the deliverability of the pipeline. In order to shave off the peaks where demand exceeds supply or the valleys where supply exceeds demand, it is desirable to store the excess gas in such a manner that it can be delivered as the market dictates. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source that is separated by great distances from the candidate market, and a pipeline either is not available or is impractical. This is particularly true where transport must be made by ocean-going vessels. Ship transportation of natural gas in the gaseous state is generally not practical because appreciable pressurization is required to significantly reduce the specific volume of the gas, and such pressurization requires the use of more expensive storage containers.

In view of the foregoing, it would be advantageous to store and transport natural gas in the liquid state at approximately atmospheric pressure. In order to store and transport natural gas in the liquid state, the natural gas is cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which may be particularly applicable to one or more embodiments of the present invention employs an open methane cycle for the final refrigeration cycle wherein a pressurized LNG-bearing stream is flashed and the flash vapors are subsequently employed as cooling agents, recompressed, cooled, combined with the processed natural gas feed stream and liquefied thereby producing the pressurized LNG-bearing stream.

Over time, concentrations of unwanted components can build up in circulating refrigerant streams of closed-loop refrigeration cycles employed in an LNG facility. These contaminants can enter the system through equipment failure and impure make-up refrigerant. When the concentration of contaminant becomes too high, the performance of the refrigeration cycle can be adversely impacted. One proposed method of managing contaminants in a closed-loop refrigerant stream involves periodically purging and replacing a small volume of refrigerant from the refrigeration cycle. The disposal and make-up refrigerant costs involved with this method of contaminant handling can be very high, especially for large LNG facilities. Another proposed solution is to purchase only high-purity make-up refrigerant. Not only is this proposed solution expensive due to the high cost of premium refrigerant, but it may also be logistically unfeasible, depending on plant location and other related factors. Yet another proposed solution is to perform a complete change-out and replacement of the contaminated stream with new refrigerant. This method, however, is time-consuming, expensive, and typically requires a plant shut down.

Thus, a need exists for a simple, flexible, cost-effective system for removing contaminants from a closed-loop refrigeration cycle in an LNG facility.

SUMMARY OF THE INVENTION

In one embodiment of the present invention, there is provided a process for removing a contaminant from a refrigerant employed in a closed-loop refrigeration cycle of a liquefied natural gas (LNG) facility. The process includes the steps of: (a) withdrawing at least a portion of the refrigerant from the closed-loop refrigeration cycle; (b) using a distillation column to separate at least a portion of the refrigerant into a contaminant-rich stream and a contaminant-depleted stream; and (c) introducing at least a portion of the contaminant-depleted stream back into the closed-loop refrigeration cycle.

In another embodiment of the present invention, there is provided a process for removing a heavy contaminant from a circulating hydrocarbon-containing refrigerant employed in a closed-loop mechanical refrigeration cycle of an LNG facility. The process includes the steps of: (a) separating the circulating refrigerant into an untreated portion and a treated portion that has an average mass flow rate less than about 10 percent of the average mass flow rate of the untreated portion; (b) using a reboiled distillation column to separate at least a portion of the treatment portion into a contaminant-rich bottom liquid stream and a contaminant-depleted overhead vapor stream; and (c) combining at least a portion of the contaminant-depleted overhead stream with at least a portion of the untreated portion of the circulating refrigerant.

In yet another embodiment of the present invention, there is provided an apparatus for removing a contaminant from a circulating refrigerant employed in a closed-loop mechanical refrigeration cycle of an LNG facility. The apparatus includes a distillation column having an inlet, an upper outlet, and a lower outlet; a feed conduit that provides fluid communication of the refrigerant between the closed-loop mechanical refrigeration cycle and the distillation column inlet; and an overhead conduit that provides fluid communication of the refrigerant between the upper outlet of the distillation column and the closed-loop mechanical refrigeration cycle.

BRIEF DESCRIPTION OF THE FIGURES

Certain embodiments of the present invention are described in detail below with reference to the enclosed figures, wherein.

DETAILED DESCRIPTION

Figure 1:
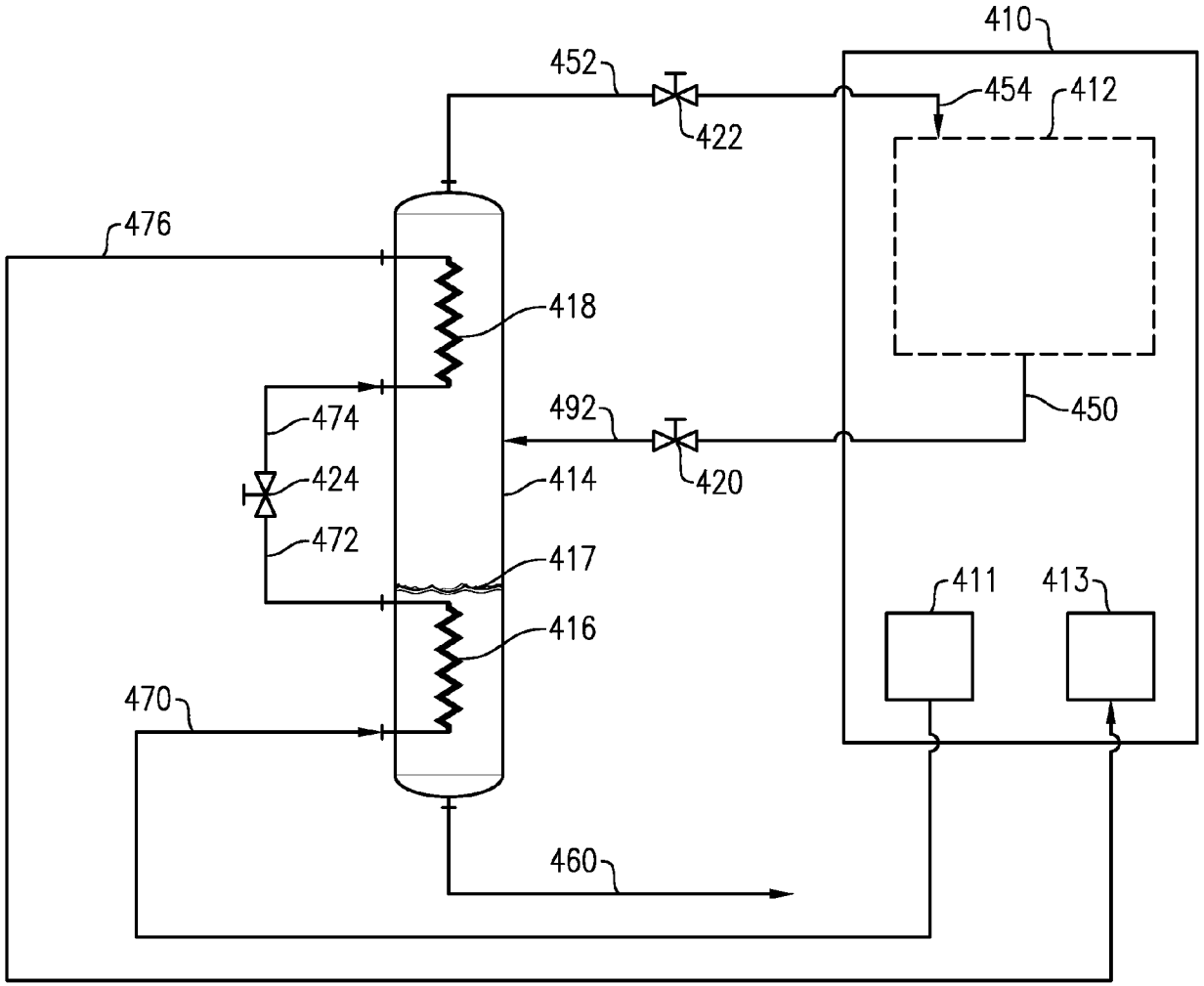
FIG. 1 is a schematic of contaminant removal system using a distillation column for the removal of a contaminant from a closed-loop refrigeration cycle in an LNG facility.

The present invention can be implemented in a process/facility used to cool natural gas to its liquefaction temperature, thereby producing liquefied natural gas (LNG). The LNG process generally employs one or more refrigerants to extract heat from the natural gas and then reject the heat to the environment. In one embodiment, the LNG process employs a cascade-type refrigeration process that uses a plurality of multi-stage cooling cycles, each employing a different refrigerant composition, to sequentially cool the natural gas stream to lower and lower temperatures. In another embodiment, the LNG process is a mixed refrigerant process that employs a mixture of two or more components to cool the natural gas stream in at least one cooling cycle.

Natural gas can be delivered to the LNG process at an elevated pressure in the range of from about 500 to about 3,000 pounds per square in absolute (psia), about 500 to about 1,000 psia, or 600 to 800 psia. Depending largely upon the ambient temperature, the temperature of the natural gas delivered to the LNG process can generally be in the range of from about 0 to about 180° F., or about 20 to about 150° F., or 60 to 125° F.

In one embodiment, the present invention can be implemented in an LNG process that employs cascade-type cooling followed by expansion-type cooling. In such a liquefaction process, the cascade-type cooling may be carried out at an elevated pressure (e.g., about 650 psia) by sequentially passing the natural gas stream through first, second, and third refrigeration cycles employing respective first, second, and third refrigerants. In one embodiment, the first and second refrigeration cycles are closed refrigeration cycles, while the third refrigeration cycle is an open refrigeration cycle that utilizes a portion of the processed natural gas as a source of the refrigerant. Further, the third refrigeration cycle can include a multi-stage expansion cycle to provide additional cooling of the processed natural gas stream and reduce its pressure to near atmospheric pressure.

In the sequence of first, second, and third refrigeration cycles, the refrigerant having the highest boiling point can be utilized first, followed by a refrigerant having an intermediate boiling point, and finally by a refrigerant having the lowest boiling point. In one embodiment, the first refrigerant has a mid-boiling point at standard temperature and pressure (i.e., an STP mid-boiling point) within about 20, about 10, or 5° F. of the STP boiling point of pure propane. The first refrigerant can contain predominately propane, propylene, or mixtures thereof. The first refrigerant can contain at least about 75 mole percent propane, at least 90 mole percent propane, or can consist essentially of propane. In one embodiment, the second refrigerant has an STP mid-boiling point within about 20, about 10, or 5° F. of the STP boiling point of pure ethylene. The second refrigerant can contain predominately ethane, ethylene, or mixtures thereof. The second refrigerant can contain at least about 75 mole percent ethylene, at least 90 mole percent ethylene, or can consist essentially of ethylene. In one embodiment, the third refrigerant has an STP mid-boiling point within about 20, about 10, or 5° F. of the STP boiling point of pure methane. The third refrigerant can contain at least about 50 mole percent methane, at least about 75 mole percent methane, at least 90 mole percent methane, or can consist essentially of methane. At least about 50, about 75, or 95 mole percent of the third refrigerant can originate from the processed natural gas stream.

The first refrigeration cycle can cool the natural gas in a plurality of cooling stages/steps (e.g., two to four cooling stages) by indirect heat exchange with the first refrigerant. Each indirect cooling stage of the refrigeration cycles can be carried out in a separate heat exchanger; in the one embodiment, core-and-kettle heat exchangers are employed to facilitate indirect heat exchange in the first refrigeration cycle. After being cooled in the first refrigeration cycle, the temperature of the natural gas can be in the range of from about −45 to about −10° F., or about −40 to about −15° F., or about −20 to −30° F. A typical decrease in the natural gas temperature across the first refrigeration cycle may be in the range of from about 50 to about 210° F., about 75 to about 180° F., or 100 to 140° F.

The second refrigeration cycle can cool the natural gas in a plurality of cooling stages/steps (e.g., two to four cooling stages) by indirect heat exchange with the second refrigerant. In one embodiment, the indirect heat exchange cooling stages in the second refrigeration cycle can employ separate, core-and-kettle heat exchangers. Generally, the temperature drop across the second refrigeration cycle can be in the range of from about 50 to about 180° F., about 75 to about 150° F., or 100 to 120° F. In the final stage of the second refrigeration cycle, the processed natural gas stream can be condensed (i.e., liquefied) in major portion, preferably in its entirety, thereby producing a pressurized LNG-bearing stream. Generally, the process pressure at this location is only slightly lower than the pressure of the natural gas fed to the first stage of the first refrigeration cycle. After being cooled in the second refrigeration cycle, the temperature of the natural gas may be in the range of from about −205 to about −70°, about −175 to about −95° F., or −140 to −125° F.

The third refrigeration cycle can include both an indirect cooling section and an expansion-type cooling section. To facilitate indirect heat exchange, the third refrigeration cycle can employ at least one brazed-aluminum plate-fin heat exchanger. The total amount of cooling provided by indirect heat exchange in the third refrigeration cycle can be in the range of from about 5 to about 60° F., about 7 to about 50° F., or 10 to 40° F.

The expansion-type cooling section of the third refrigeration cycle can further cool the pressurized LNG-bearing stream via sequential pressure reduction to approximately atmospheric pressure. Such expansion-type cooling can be accomplished by flashing the LNG-bearing stream to thereby produce a two-phase vapor-liquid stream. When the third refrigeration cycle is an open refrigeration cycle, the expanded two-phase stream can be subjected to vapor-liquid separation and at least a portion of the separated vapor phase (i.e., the flash gas) can be employed as the third refrigerant to help cool the processed natural gas stream. The expansion of the pressurized LNG-bearing stream to near atmospheric pressure can be accomplished by using a plurality of expansion steps (i.e., two to four expansion steps) where each expansion step is carried out using an expander. Suitable expanders include, for example, either Joule-Thomson expansion valves or hydraulic expanders. In one embodiment, the third stage refrigeration cycle can employ three sequential expansion cooling steps, wherein each expansion step can be followed by a separation of the gas-liquid product. Each expansion-type cooling step can further cool the LNG-bearing stream in the range of from about 10 to about 60° F., about 15 to about 50° F., or 25 to 35° F. The reduction in pressure across the first expansion step can be in the range of from about 80 to about 300 psia, about 130 to about 250 psia, or 175 to 195 psia. The pressure drop across the second expansion step can be in the range of from about 20 to about 110 psia, about 40 to about 90 psia, or 55 to 70 psia. The third expansion step can further reduce the pressure of the LNG-bearing stream by an amount in the range of from about 5 to about 50 psia, about 10 to about 40 psia, or 15 to 30 psia. The liquid fraction resulting from the final expansion stage is the final LNG product. The liquid fraction resulting from the final expansion stage is the LNG product. Generally, the temperature of the LNG product can be in the range of from about −200 to about −300° F., about −225 to about −275° F., or −240 to −260° F. The pressure of the LNG product can be in the range of from about 0 to about 40 psia, about 10 to about 20 psia, or 12.5 to 17.5 psia.

The natural gas feed stream to the LNG process will usually contain such quantities of C2+ components so as to result in the formation of a C2+ rich liquid in one or more of the cooling stages of the second refrigeration cycle. Generally, the sequential cooling of the natural gas in each cooling stage is controlled so as to remove as much of the C2 and higher molecular weight hydrocarbons as possible from the gas, thereby producing a vapor stream predominating in methane and a liquid stream containing significant amounts of ethane and heavier components. This liquid can be further processed via gas-liquid separators employed at strategic locations downstream of the cooling stages. In one embodiment, one objective of the gas/liquid separators is to maximize the rejection of the C5+ material to avoid freezing in downstream processing equipment. The gas/liquid separators may also be utilized to vary the amount of C2 through C4 components that remain in the natural gas product to affect certain characteristics of the finished LNG product.

The exact configuration and operation of gas-liquid separators may be dependant on a number of parameters, such as the C2+ composition of the natural gas feed stream, the desired BTU content of the LNG product, the value of the C2+ components for other applications, and other factors routinely considered by those skilled in the art of LNG plant and gas plant operation. In one embodiment of the present invention, the C2+ hydrocarbon stream or streams may be demethanized via a single stage flash or a fractionation column. The gaseous methane-rich stream can be directly returned at pressure to the liquefaction process. The resulting heavies-rich liquid stream may then be subjected to fractionation in one or more fractionation zones to produce individual streams rich in specific chemical constituents (e.g., $C_2$, $C_3$, $C_4$, and $C_5$+).

According to one embodiment of the present invention, a slipstream of circulating refrigerant can be withdrawn from a circulating refrigerant stream employed in a closed-loop refrigeration cycle of an LNG facility and the slip stream can then be treated to remove at least a portion of a contaminant. As used herein, the term "contaminant" refers to any unwanted component or any mixture of unwanted components. In one embodiment, the contaminant may be a high molecular weight oil, such as lubrication oil used in a compressor. In another embodiment, the contaminant may be a hydrocarbon that is less volatile than the refrigerant. For example, isobutane may be considered a contaminant in a propane refrigerant stream.

In one embodiment, a distillation column is used to separate the slipstream of refrigerant into a contaminant-rich and a contaminant-depleted stream so that at least a portion of the contaminant-depleted stream can subsequently be returned to the closed-loop refrigeration cycle. As used herein, the term "contaminant-rich stream" refers to the separated stream having a concentration of contaminant greater than 100 percent on a weight basis of the concentration of the contaminant in the stream subjected to separation. As used herein, the term "contaminant-depleted stream" refers to the separated stream having a concentration of contaminant less than 100 percent on a weight basis of the concentration of the contaminant in the stream subjected to separation. In accordance with one embodiment of the present invention, the concentration of the contaminant in the contaminant-rich stream can be at least about 110 percent, at least about 125 percent, at least about 150 percent, or at least 200 percent on a weight basis of the concentration of the contaminant in the refrigerant stream entering the distillation column prior to separation. In another embodiment, the contaminant-depleted stream can have a concentration of contaminant less than about 90 percent, less than about 50 percent, less than about 20 percent, or less than 5 percent on a weight basis of the concentration of the contaminant in the refrigerant stream entering the distillation column prior to separation.

According to one embodiment of the present invention, the distillation column includes a reboiler and/or a condenser. In one embodiment, the reboiler can utilize a process stream to heat, via direct or indirect heat exchange, at least a portion of the refrigerant stream fed to the distillation column. In another embodiment, the condenser can employ a process stream to cool, by direct or indirect heat exchange, at least a portion of the refrigerant feed stream fed to the distillation column. In yet another embodiment, both the reboiler and condenser can use at least a portion of the same process stream to heat and cool, respectively, at least a portion of the distillation column's refrigerant feed stream via direct or indirect heat exchange. In a further embodiment, the process stream can comprise a refrigerant that originates from and returns to the same closed-loop refrigeration cycle that utilizes the distillation column for contaminant removal.

Figure 2A:
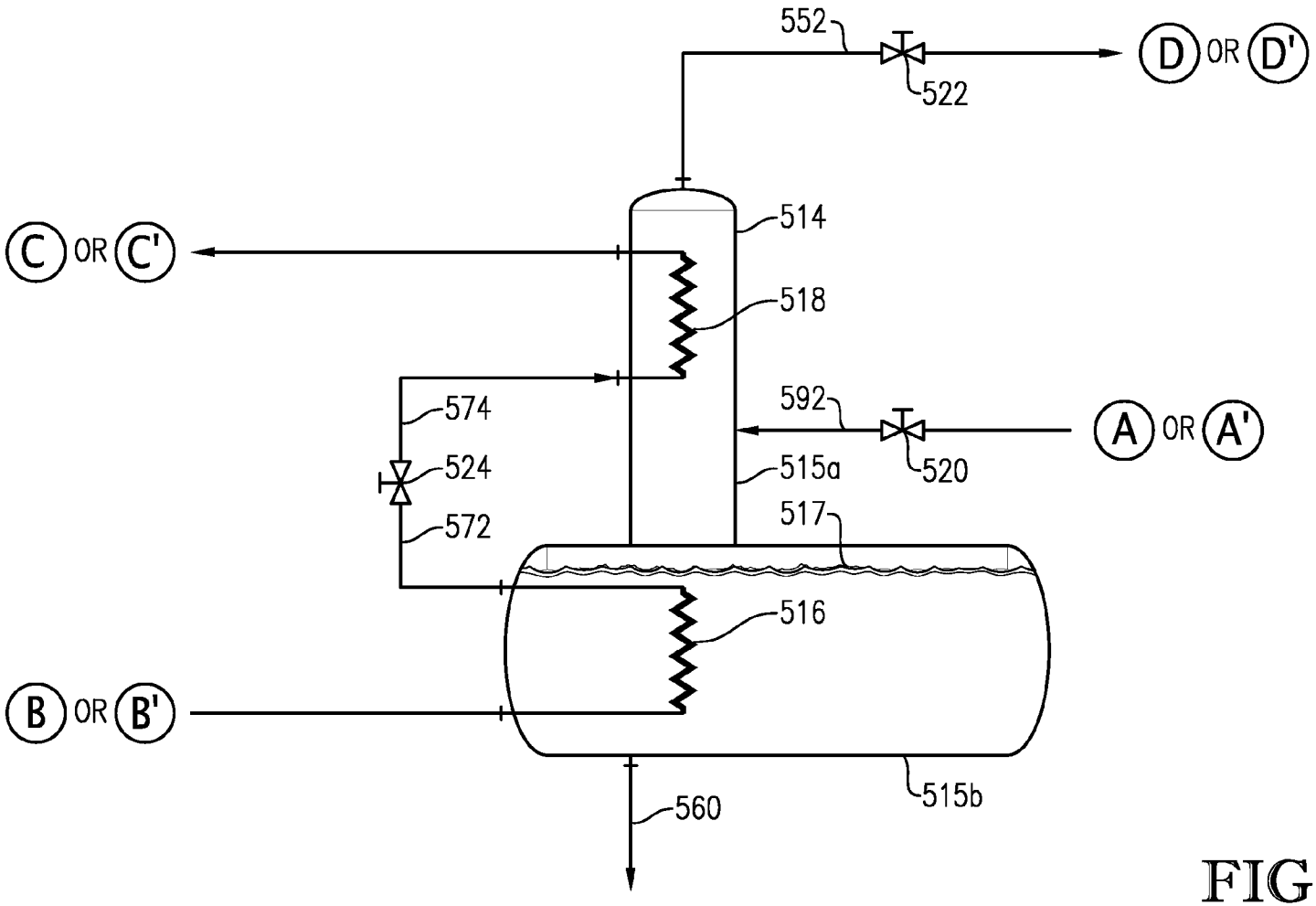
FIG. 2*a* is a schematic of a contaminant removal system employing a distillation column for the removal of a contaminant from one or more closed-loop refrigeration cycles in the LNG facility illustrated in FIG. 2*b*. Lines A, A', B, B', C, C', D, and D' illustrate how the contaminant removal system in FIG. 2*a* can be integrated into the LNG facility shown in FIG. 2*b*.
Figure 2B:
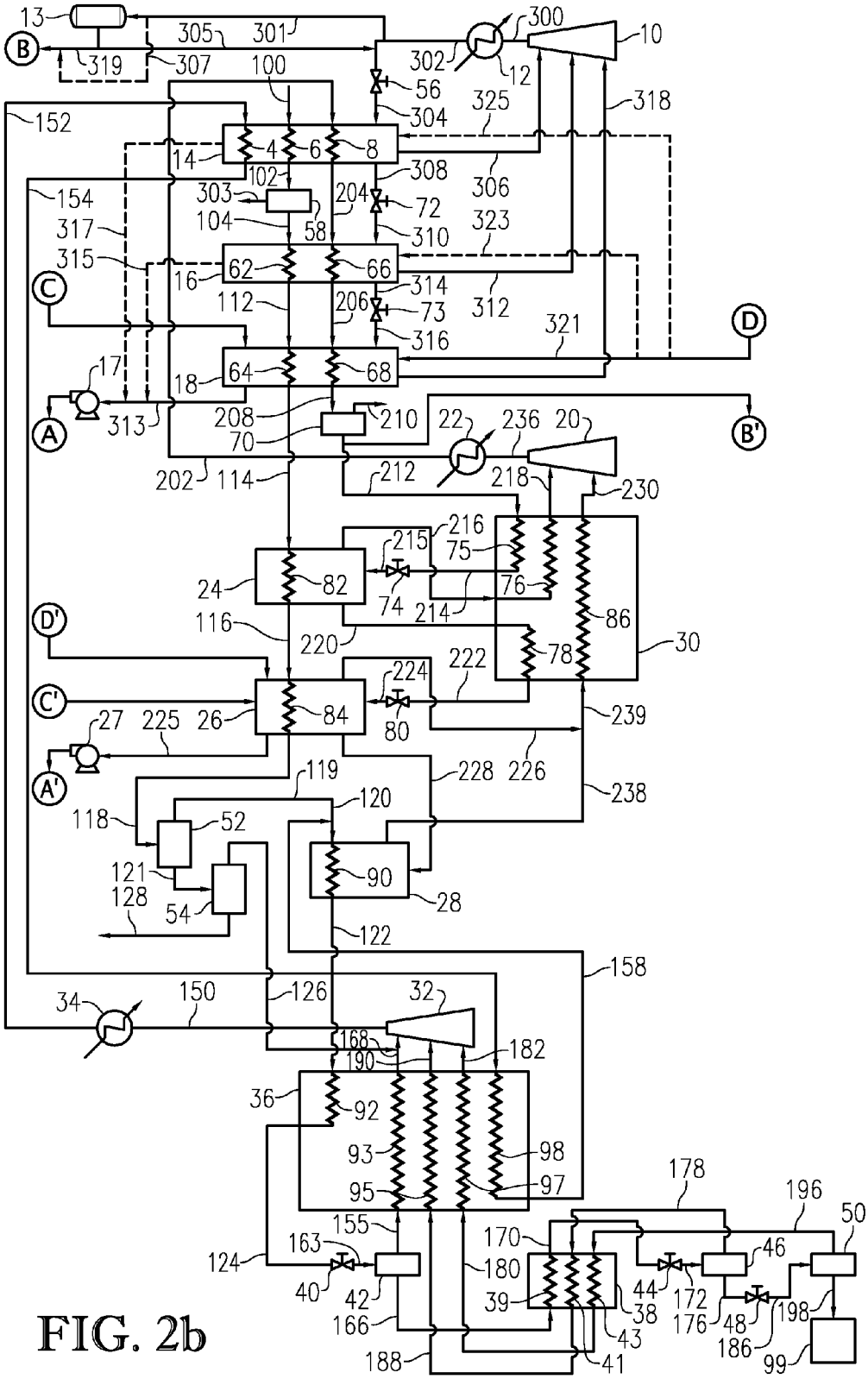
FIG. 2*b* is a simplified flow diagram of an LNG facility having a contaminant removal system that employs a distillation column for removing contaminants from one or more closed-loop refrigeration cycles. Certain portions of the LNG facility in FIG. 2*b* connect to the contaminant removal system illustrated in FIG. 2*a* via lines A, A', B, B', C, C', D, and D'.

The flow schematics and apparatuses illustrated in FIGS. 1, 2*a*, and 2*b* represent several embodiments of the present invention. Those skilled in the art will recognize that FIGS. 1, 2*a*, and 2*b* are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1, 2*a*, and 2*b*, the following numeric nomenclature was employed. Items numbered 1 through 99 are process vessels and equipment which are directly associated with the liquefaction process in FIG. 2*b*. Items numbered 100 through 199 correspond to flow lines or conduits that contain predominantly methane streams in FIG. 2*b*. Items numbered 200 through 299 correspond to flow lines or conduits that contain predominantly ethylene streams in FIG. 2*b*. Items numbered 300 through 399 correspond to flow lines or conduits that contain predominantly propane streams illustrated in FIG. 2*b*. Items numbered 400 through 499 represent equipment, vessels, or flow conduits in FIG. 1. Items numbered 500 through 599 represent equipment, vessels, or flow conduits associated with the contaminant removal system shown in FIG. 2*a*.

Referring now to FIG. 1, one embodiment of a distillation column to remove a contaminant from a closed-loop refrigerant cycle according to the present invention is illustrated. The main components of FIG. 1 include the liquefaction portion of an LNG process/facility 410, a process stream source 411, a closed-loop mechanical refrigeration cycle 412, a process stream destination 413, and a distillation column 414. Liquefaction portion of the LNG facility 410 employs at least one mechanical refrigeration cycle, illustrated here as closed-loop mechanical refrigeration cycle 412, and includes a process stream source 411 and a process stream destination 413. In the embodiment illustrated in FIG. 1, a slipstream of the circulating refrigerant in closed-loop mechanical refrigeration cycle 412 is withdrawn via conduit 450. The average mass flow rate of the refrigerant stream in conduit 450 is less than about 10 percent, less than about 5 percent, or less than 2 percent of the average mass flow rate of the circulating refrigerant stream remaining in refrigeration cycle 412.

The refrigerant stream in conduit 450 passes through a pressure reduction means, illustrated here as expander 420, whereupon the pressure of the stream is reduced and a portion of the stream is vaporized or flashed. The resulting two-phase stream enters the inlet of distillation column 414 via feed conduit 492. Distillation column 414 can be any device known in the art for the separation of vapor and liquid. In one embodiment, distillation column 414 can comprise internals, such as, for example, trays, random packing, structured packing, and any combination thereof. Distillation column 414 may be of any shape and size known in the art. As illustrated in the embodiment shown in FIG. 1, the contaminant-depleted, predominantly vapor overhead stream exits an upper outlet of distillation column 414 via overhead conduit 452. The stream then passes through a pressure reduction means, illustrated here as expander 422, and the resulting cooled stream reenters closed-loop refrigeration cycle 412 via conduit 454. The predominantly liquid, contaminant-rich bottoms stream exits through a lower outlet of distillation column 414 and is subsequently routed via conduit 460 to storage, further processing, or disposal.

Distillation column 414 additionally comprises a reboiler 416 and a condenser 418. In one embodiment of the present invention, condenser 418 and reboiler 416 can be positioned in the upper and lower portions, respectively, of distillation column 414. According to the embodiment illustrated in FIG. 1, a process stream flows via conduit 470 from process stream source 411 into the inlet of reboiler 416. Reboiler 416 heats at least a portion of the predominantly liquid phase in the bottom portion of distillation column 414. In one embodiment, reboiler 416 can be an internal reboiler located at least about 50 percent, at least about 75 percent, or at least 95 percent below in the normal liquid level 417 at the bottom of distillation column 414. In another embodiment, reboiler 416 can be located completely below liquid level 417 in the lower portion of distillation column 414. The process stream then exits the outlet of reboiler 416 in conduit 472 and passes through expander 424. The resulting, cooled stream flows via conduit 474 into the inlet of condenser 418, wherein the stream cools at least a portion of the predominantly vapor phase in the upper portion of distillation column 414. The process stream passes through the outlet of condenser 418 and enters conduit 476, wherein the stream is routed to process stream destination 413 in liquefaction portion of LNG facility 410.

Turning now to FIG. 2*a*, another embodiment of the inventive contaminant removal system is illustrated. According to one embodiment the contaminant removal system illustrated in FIG. 2*a* can be used to remove a contaminant from the closed-loop propane refrigeration cycle of the LNG facility illustrated in FIG. 2*b*. Lines A, B, C, and D show how the contaminant removal system of FIG. 2*a* can be integrated into the propane refrigeration cycle of the LNG facility of FIG. 2*b*. In another embodiment, the contaminant removal system represented by FIG. 2*a* can be used to remove a contaminant from the closed-loop ethylene refrigeration cycle shown in FIG. 2*b*. Lines A', B', C', and D' show how the contaminant removal system of FIG. 2*a* can be integrated into the ethylene refrigeration cycle of the LNG facility of FIG. 2*b*. In another embodiment (not shown), the inventive contaminant removal system illustrated in FIG. 2*a* could be employed to remove a contaminant from a closed-loop methane refrigeration cycle.

Turning to FIG. 2*a*, the main components of the contaminant removal system include a distillation column 514 with a vertically-elongated upper portion 515*a*, horizontally-elongated lower portion 515*b*, a reboiler 516, and a condenser 518.

Referring now to FIG. 2*b*, the main components of the propane refrigeration cycle include a propane compressor 10, a propane cooler 12, a propane accumulator 13, a high-stage propane chiller 14, an intermediate stage propane chiller 16, and a low-stage propane chiller 18. The main components of the ethylene refrigeration cycle include an ethylene compressor 20, an ethylene cooler 22, a high-stage ethylene chiller 24, an intermediate-stage ethylene chiller 26, and a low-stage ethylene chiller/condenser 28, and an ethylene economizer 30. The main components of the methane refrigeration cycle's heat exchange cooling section include a methane compressor 32, a methane cooler 34, a main methane economizer 36, and a secondary methane economizer 38. The main components of the methane refrigeration cycle's expansion cooling section include a high-stage methane expander 40, a high-stage methane flash drum 42, an intermediate-stage methane expander 44, an intermediate-stage methane flash drum 46, a low-stage methane expander 48, and a low-stage methane flash drum 50. In addition, the LNG facility in FIG. 2*b* includes a first distillation column 52 and a second distillation column 54 for heavies removal and natural gas liquids (NGL) recovery.

The operation of the contaminant removal system and the LNG facility illustrated in FIGS. 2*a* and 2*b* will now be described in more detail, beginning with the propane refrigeration cycle of the LNG facility in FIG. 2*b*. The compressed propane is discharged from propane compressor 10 and then passed through conduit 300 to propane cooler 12, wherein it is cooled and liquefied via indirect heat exchange with an external fluid (e.g., air or water). The three stages of compression in propane compressor 10 preferably exist in a single unit, although each stage of compression may be a separate unit and the units mechanically coupled to be driven by a single driver. A representative pressure and temperature of the liquefied propane refrigerant exiting cooler 12 is about 100° F. and about 190 psia. The stream in conduit 302 exits propane cooler 12, whereupon the stream splits into a first portion and a second portion. The first portion enters conduit 301 and enters propane accumulator 13. Optionally, a portion of the stream in conduit 301 can be routed via conduit 307 into yet-to-be-discussed conduit B. A predominantly liquid propane refrigerant stream exits propane accumulator 13 via conduit 305 and, thereafter, splits into two portions. The first portion is routed via conduit 319 into conduit B and then to the contaminant removal system illustrated in FIG. 2*a*, which will be discussed in more detail in a subsequent section. The second portion in conduit 305 combines with the second portion of the cooled propane refrigerant stream exiting propane cooler 12 in conduit 302 and passes through a pressure reduction means, illustrated as expansion valve 56, wherein the pressure of the liquefied propane is reduced, thereby evaporating or flashing a portion thereof.

The resulting two-phase product then flows through conduit 304 into high-stage propane chiller 14. High stage propane chiller 14 uses indirect heat exchange means 4, 6, and 8 to cool, respectively, the incoming gas streams, including methane refrigerant in conduit 152, natural gas feed in conduit 100, and ethylene refrigerant in conduit 202. Cooled methane refrigerant gas exits high-stage propane chiller 14 through conduit 154 and is fed to main methane economizer 36, which will be discussed in greater detail shortly. The cooled natural gas stream, also referred to herein as the methane-rich stream, from high-stage propane chiller 14 flows via conduit 102 to a separation vessel 58 wherein gas and liquid phases are separated. The liquid phase, which can be rich in C3+ components, is removed via conduit 303. The vapor phase is removed via conduit 104 and fed to intermediate-stage propane chiller 16 wherein the stream is cooled via an indirect heat exchange means 62. The resultant vapor/liquid stream is then routed to low-stage propane chiller 18 via conduit 112 wherein it is cooled by an indirect heat exchange means 64. The cooled methane-rich stream then flows through conduit 114 and enters high-stage ethylene chiller 24, which will be discussed further in a subsequent section.

The propane gas from high-stage propane chiller 14 is returned to the high-stage inlet port of propane compressor 10 via conduit 306. The residual liquid propane exits high-stage propane chiller 14 via conduit 308 and passes through a pressure reduction means, illustrated here as expansion valve 72, whereupon an additional portion of the liquefied propane is flashed or vaporized. The resulting cooled, two-phase stream enters intermediate-stage propane chiller 16 by means of conduit 310, thereby providing coolant for chiller 16. The vapor portion of the propane refrigerant exits intermediate-stage propane chiller 16 via conduit 312 and is fed to the intermediate-stage inlet port of propane compressors 10. The remaining liquid propane exits intermediate-stage propane chiller 16 via conduit 314 and passes through a pressure-reduction means, illustrated here as expansion valve 73, whereupon a portion of the propane refrigerant stream is vaporized.

The resulting vapor/liquid stream then enters low-stage propane chiller 18 via conduit 316 and acts as a coolant for the methane-rich and ethylene refrigerant streams entering low-stage propane chiller 18 via conduits 112 and 206, respectively. The vaporized propane refrigerant stream then exits low-stage propane chiller 18 and is routed to the low-stage inlet port of propane compressors 10 via conduit 318 wherein the refrigerant is compressed and recycled through the previously described propane refrigeration cycle.

As illustrated in FIG. 2*b*, a slipstream of propane refrigerant is withdrawn from low-stage propane chiller 18 via conduit 313 and fed to the suction of propane pump 17. Alternatively, a propane refrigerant stream may be withdrawn from the intermediate-stage propane chiller 16 via conduit 315 or high-stage propane chiller 14 via conduit 317 and sent to the suction of propane pump 17. Propane pump 17 then discharges the propane refrigerant stream into conduit A, whereupon the stream flows into the contaminant removal system illustrated in FIG. 2*a*. Turning now to FIG. 2*a*, the stream in conduit A passes through a pressure reduction means, illustrated herein as expander 520, wherein the pressure of the stream is reduced to thereby vaporize or flash a portion thereof. The resulting two-phase propane stream then enters distillation column 514, via feed conduit 592. In one embodiment, distillation column 514 can comprise internals, such as, for example, trays, random packing, structured packing, and any combination thereof. Distillation column 514 may be of any shape and size known in the art. In one embodiment, distillation column 514 may be vertically elongated with an upper and lower portion. The upper and lower portions of distillation column may have horizontal dimensions (D) such that the lower horizontal dimension ($D_L$) is at least about 1.0, at least about 1.1, or at least 1.5 times the upper horizontal dimension ($D_U$). For example, in one embodiment, the lower diameter of a cylindrical distillation column can be at least about 1.1 times the column's upper diameter.

The predominantly vapor, contaminant-depleted propane refrigerant stream in overhead conduit 552 exits the upper outlet of distillation column 514 and passes through expander 522 and into conduit D. The stream in conduit D is then routed back to the low-stage, intermediate-stage, or high-stage propane chiller 18, 16, or 14 in FIG. 2*b* via respective conduit 321, 323, or 325. As shown in FIG. 2*a*, the resulting, predominantly liquid contaminant-depleted stream exits the lower outlet of distillation column 514 and is routed to subsequent processing, storage, or disposal via conduit 560.

As previously mentioned, the propane refrigerant stream in conduit B exiting propane accumulator 13 in FIG. 2*b* is routed to the contaminant removal system illustrated in FIG. 2*a*. As shown in FIG. 2*a*, the propane refrigerant stream enters the inlet of reboiler 516. In the embodiment illustrated in FIG. 2*a*, reboiler 516 is located in the lower portion 515*b* of distillation column 514 and can be greater than about 25 percent, greater than about 50 percent, greater than about 75 percent, or greater than 95 percent below the normal operating liquid level 517 of lower portion 515*b* of distillation column 514. Reboiler 516 uses the propane stream in conduit B to heat at least a portion of the liquid in the lower portion 515*b* of distillation column 514 via indirect heat exchange. The propane stream then exits the outlet of reboiler 516 via conduit 572 and passes through expander 524. The resulting cooled stream flows via conduit 574 into the inlet of condenser 518, wherein the stream cools at least a portion of the predominantly vapor phase in the upper portion 515*a* of distillation column 514. The propane stream exits the outlet of condenser 518 and is routed back to the low-stage propane chiller 18 of the closed-loop propane refrigeration cycle of the LNG facility in FIG. 2*b* via conduit C.

Referring now to the ethylene refrigerant stream entering high-stage propane chiller 14 in FIG. 2*b*, the stream is cooled via indirect heat exchange means 8. The cooled ethylene refrigerant stream then exits high-stage propane chiller 14 via conduit 204. The partially condensed stream enters intermediate-stage propane chiller 16 wherein it is further cooled by an indirect heat exchange means 66. The two-phase ethylene stream is then routed to low-stage propane chiller 18 by means of conduit 206 wherein the stream is totally condensed or condensed nearly in its entirety via indirect heat exchange means 68. The ethylene refrigerant stream is then fed via conduit 208 to a separation vessel 70 wherein the vapor portion, if present, is removed via conduit 210. The liquid ethylene refrigerant is then fed to the ethylene economizer 30 by means of conduit 212. The ethylene refrigerant at this location in the process is generally at a temperature of about −24° F. and a pressure of about 285 psia.

In one embodiment, the closed-loop ethylene refrigeration cycle illustrated in FIG. 2*b* can have a distinct contaminant removal system that is configured and operated in a like manner to the system described for the closed-loop propane refrigeration system shown in FIG. 2*a*. For the sake of brevity, the system shown in FIG. 2*a* will also be used to describe the operation of the ethylene contaminant removal system, although it should be understood that the contaminant removal systems for the propane and ethylene refrigeration systems in FIG. 2*b* are preferably independent from each other.

Turning now to the ethylene refrigeration cycle illustrated in FIG. 2*b*, the ethylene refrigerant exiting separator 70 splits into two portions. The first portion is routed via conduit B' to the contaminant removal system illustrated in FIG. 2*a*, which will be described in more detail shortly. The second portion of the ethylene refrigerant stream exiting separator 70 enters ethylene economizer 30 and is cooled via an indirect heat exchange means 75. The sub-cooled liquid ethylene stream flows through conduit 214 to a pressure reduction means, illustrated here as expansion valve 74, whereupon a portion of the stream is flashed. The cooled, vapor/liquid stream enters high-stage ethylene chiller 24 through conduit 215 wherein it acts as a coolant for the methane-rich stream flowing through an indirect heat exchange means 82. The vapor and liquid portions of the ethylene refrigerant stream exit chiller 24 via conduits 216 and 220, respectively. The ethylene refrigerant vapors are routed back to the ethylene economizer 30, warmed via an indirect heat exchange means 76, and subsequently fed via conduit 218 to the high-stage inlet port of ethylene compressor 20. The liquid portion of the ethylene refrigerant stream is then further cooled in an indirect heat exchange means 78 of ethylene economizer 30. The resulting cooled ethylene stream exits ethylene economizer 30 via conduit 222 and passes through a pressure reduction means, illustrated here as expansion valve 80, whereupon a portion of the ethylene is flashed.

In a manner similar to high-stage ethylene chiller 24, the two-phase refrigerant stream enters intermediate-stage ethylene chiller 26 via conduit 224 and cools the natural gas stream flowing through an indirect heat exchange means 84 via conduit 116. A slip stream of ethylene refrigerant is withdrawn from intermediate-stage ethylene chiller 26 via conduit 225 and is discharged via ethylene pump 27 into conduit A', whereafter the stream flows into the contaminant removal system illustrated in FIG. 2*a*. The contaminant removal system shown in FIG. 2*a* for the ethylene refrigeration cycle operates analogously to the system described previously with respect to the propane refrigeration cycle. The predominantly vapor, contaminant-depleted overhead stream in conduit 552 passes through expander 522 and enters conduit D', whereafter it flows back into the intermediate-stage ethylene chiller 26 in FIG. 2*b*.

The previously-discussed stream in conduit B' flows into the ethylene contaminant removal system illustrated in FIG. 2*a* and, subsequently heats and cools at least a portion of the refrigerant stream in distillation column 514 as previously discussed. The resulting stream exits the outlet of condenser 518 in the ethylene contaminant removal system of FIG. 2*a* and is thereafter routed back into the intermediate-stage ethylene chiller 26 in FIG. 2*b* via conduit C'.

Referring back to the methane-rich stream exiting intermediate-stage ethylene chiller 26 in the LNG facility illustrated in FIG. 2*b*, the totally condensed or nearly totally condensed stream is routed via conduit 118 to first distillation column 52 of the heavies removal/NGL recovery section of the inventive LNG facility. The overhead, predominantly vapor product exits first distillation column 52 via conduit 119 and combines with a yet-to-be-discussed stream in conduit 120 prior to entering low-stage ethylene chiller/condenser 28. The predominantly liquid bottoms stream from first distillation column 52 is routed to second distillation column 54. The bottoms liquid product from second distillation column 54 can be rich in ethane and heavier components and can be routed to further processing, fractionation, and/or storage via conduit 128. The predominantly methane vapor overhead stream exiting second distillation column 54 in conduit 126 combines with a yet-to-be-discussed stream in conduit 168 prior to entering the high-stage suction port of methane compressor 32.

Turning back to intermediate-stage ethylene chiller 26, the vapor and liquid portions of the ethylene refrigerant stream exit ethylene chiller 26 via conduits 226 and 228, respectively. The gaseous stream in conduit 226 combines with a yet-to-be-described ethylene vapor stream in conduit 238. The combined ethylene refrigerant stream enters ethylene economizer 30 via conduit 239, is warmed by an indirect heat exchange means 86, and is fed to the low-stage inlet port of ethylene compressor 20 via conduit 230. Preferably, the three stages of compression in ethylene compressor 20 preferably exist in a single unit, although each stage of compression may be a separate unit and the units mechanically coupled to be driven by a single driver. The compressed ethylene product from ethylene compressor 20 flows via conduit 236 to ethylene cooler 22, wherein it is cooled via indirect heat exchange with an external fluid (e.g., air or water). The resulting condensed ethylene refrigerant stream is then introduced via conduit 202 to high-stage propane chiller 14 for recycle through the ethylene refrigeration cycle, as previously described.

The liquid portion of the ethylene refrigerant stream from intermediate-stage ethylene chiller 26 in conduit 228 enters low-stage ethylene chiller/condenser 28 and cools the composite methane-rich stream in conduit 120 via an indirect heat exchange means 90. The vaporized ethylene refrigerant from low-stage ethylene chiller/condenser 28 flows via conduit 238 and combines with the ethylene vapors from the intermediate-stage ethylene chiller in conduit 226. The combined ethylene refrigerant vapor stream is then heated by the indirect heat exchange means 86 in the ethylene economizer 30 prior to entering the low-stage suction port of ethylene compressors 20 as described previously. The pressurized, LNG-bearing stream exiting the ethylene refrigeration cycle via conduit 122 can be at a temperature in the range of from about −200 to about −50° F., about −175 to about −100° F., or −150° F. to −125° F. and a pressure in the range from about 500 to 700 psia, or 550 to 725 psia.

Turning now to the methane refrigeration cycle, the pressurized, methane-rich stream in conduit 122 is then routed to the main methane economizer 36, wherein it is further cooled by an indirect heat exchange means 92. The stream exits through conduit 124 and enters the expansion-cooling section of the methane refrigeration cycle. The liquefied predominantly methane stream is then passed through a pressure-reduction means, illustrated here as high-stage methane expander 40, whereupon a portion of the stream is vaporized. The resulting two-phase product enters high-stage methane flash drum 42 via conduit 163 wherein the gaseous and liquid portions are separated. The high-stage methane flash gas in conduit 155 is transported to main methane economizer 36, wherein it is heated via an indirect heat exchange means 93. The resulting stream exits main methane economizer 36 via conduit 168 and combines with the second distillation column vapor product in conduit 126 as previously noted. The combined stream then enters the high-stage inlet port of methane compressor 32, which is driven by gas turbine driver 33. Preferably, the three compressor stages are a single module, although they may each be a separate module and the modules may be mechanically coupled to a common driver.

The liquid product from high-stage flash drum 42 enters secondary methane economizer 38 via conduit 166, wherein the stream is cooled via an indirect heat exchange means 39. The resulting cooled stream flows via conduit 170 to a pressure reduction means, illustrated here as intermediate-stage expansion valve 44, wherein a portion of the liquefied methane stream is vaporized. The resulting two-phase stream in conduit 172 then enters intermediate-stage methane flash drum 46 wherein the liquid and vapor phases are separated and exit via conduits 176 and 178, respectively. The vapor portion enters secondary methane economizer 38, is heated by an indirect heat exchange means 41, and then reenters main methane economizer 36 via conduit 188. The stream is further heated by indirect heat exchange means 95 before being fed into the intermediate-stage inlet port of methane compressor 32 via conduit 190.

The liquid product from the bottom of intermediate-stage flash drum 46 then enters the final stage of the expansion cooling section as it is routed via conduit 176 through a pressure reduction means, illustrated here as low-stage methane expander 48, whereupon a portion of the liquid stream is vaporized. The cooled, mixed-phase product is routed to low-stage methane flash drum 50 by means of conduit 186 wherein the vapor and liquid portions are separated. The liquefied natural gas (LNG) product, which is at approximately atmospheric pressure, exits low-stage methane flash drum 50 via conduit 198 and can be routed to storage vessel 99. In another embodiment, the LNG product can be subsequently routed to an onsite or offsite re-gasification unit.

As shown in FIG. 1, the vapor stream exits low-stage methane flash drum 50 via conduit 196 and enters secondary methane economizer 38 wherein it is heated via an indirect heat exchange means 43. The stream then travels via conduit 180 to main methane economizer 36 wherein it is further cooled by an indirect heat exchange means 97. The vapor then enters the high-stage inlet port of methane compressor 32 by means of conduit 182. The resulting compressed stream is discharged into conduit 192 and passes through ethylene cooler 34, wherein it is cooled via indirect heat exchange with an external fluid (e.g., air or water). The product of cooler 34 is then introduced via conduit 152 to high-stage propane chiller 14 for additional cooling via indirect heat exchange means 4 as previously discussed.

As previously noted, the methane refrigerant stream from high-stage propane chiller 14 in conduit 154 enters main methane economizer 36 wherein it is further cooled via indirect heat exchange means 98. The resulting cooled, methane-rich stream exits main methane economizer 36 via conduit 160 and is combined with the cooled natural gas effluent in conduit 119 from the overhead of first distillation column 54 of the heavies removal/NGL recovery section of the inventive LNG facility. The combined stream in conduit 120 then enters low-stage ethylene chiller/condenser 28, as previously discussed, to ultimately become the final LNG product.

The inventive contaminant-removal system can be utilized in several ways in order to remove a contaminant from a refrigerant stream. In one embodiment, the process can take place on an intermittent basis. In accordance with one embodiment, the distillation column may be operable only when contaminant levels exceed a certain concentration. In another embodiment, the contaminant removal system may be operable based on a predetermined time interval. In a yet another embodiment, the previously-described process may be carried out on a semi-continuous basis in order to purify new refrigerant entering the system prior to or immediately following start-up of an LNG facility. In a further embodiment, the inventive process may be used to remove a contaminant from a make-up refrigerant stream while the LNG facility is operable.

In one embodiment of the present invention, the LNG production systems illustrated in FIGS. 1, 2*a*, and 2*b* are simulated on a computer using conventional process simulation software in order to produce simulation results. In one embodiment, the simulation results can be in the form of a computer print out. In another embodiment, the simulation results can be displayed on a screen, monitor, or other viewing device. In yet another embodiment, the simulation results may be electronic signals directly communicated into the LNG system for direct control and/or optimization of the system.

The simulation results can then be used to manipulate the LNG system. In one embodiment, the simulation results can be used to design a new LNG facility and/or revamp or expand an existing LNG facility. In another embodiment, the simulation results can be used to optimize the LNG facility according to one or more operating parameters. In a further embodiment, the computer simulation can directly control the operation of the LNG facility by, for example, manipulating control valve output. Examples of suitable software for producing the simulation results include HYSYS™ or Aspen Plus®, available from Aspen Technology, Inc., and PRO/II®, available from Simulation Sciences Inc.

Numeric Ranges

The present description uses numeric ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "cascade refrigeration process" refers to a refrigeration process that employs a plurality of refrigeration cycles, each employing a different pure component refrigerant to successively cool natural gas.

As used herein, the term "condenser" refers to a device used to cool at least a portion of a stream being separated in a distillation column.

As used herein, the terms "containing," "contains," and "contain" have the same open-ended meaning as "comprising," "comprises," and "comprise," as defined below.

As used herein, the term "contaminant" refers to any unwanted component or any mixture of unwanted components.

As used herein, the term "contaminant-depleted stream" refers to a separated stream having a concentration of contaminant less than 100 percent on a weight basis of the concentration of the contaminant in the stream subjected to separation.

As used herein, the term "contaminant-rich stream" refers to a separated stream having a concentration of contaminant greater than 100 percent on a weight basis of the concentration of the contaminant in the stream subjected to separation.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the term "distillation column" refers to a device used for separating a stream into liquid and gas phases.

As used herein, the terms "having," "have," and "have" have the same open-ended meaning as "comprising," "comprises," and "comprise," as defined above.

As used herein, the term "hydrocarbon-containing" refers to material that contains at least 5 mole percent of one or more hydrocarbon compounds.

As used herein, the terms "including," "include," and "include" have the same open-ended meaning as "comprising," "comprises," and "comprise," as defined above.

As used herein, the term "make-up refrigerant stream" refers to a stream of refrigerant added to a closed-loop refrigeration cycle during cycle operation.

As used herein, the term "mixed refrigerant" means a refrigerant containing a plurality of different components, where no single component makes up more than 75 mole percent of the refrigerant.

As used herein, the term "pure component refrigerant" means a refrigerant that is not a mixed refrigerant.

As used herein, the term "reboiled distillation column" refers to a distillation column comprising a reboiler.

As used herein, the term "reboiler" a device used to heat at least a portion of a stream being separated in a distillation column.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for removing a contaminant from a refrigerant employed in a closed-loop refrigeration cycle of a liquefied natural gas facility, the process comprising:

withdrawing a first portion of the refrigerant following at least one expansion of the refrigerant in the closed-loop refrigeration cycle;

withdrawing a second portion of the refrigerant in a predominantly liquid phase and upstream of the at least one expansion of the first portion of the refrigerant in the closed-loop refrigeration cycle;

separating via a distillation column the first portion of the refrigerant into a contaminant-rich bottom stream and a contaminant-depleted overhead stream, wherein the distillation column includes a first indirect heat exchanger for heating liquids of the first portion of the refrigerant in a lower area of the distillation column using the second portion of the refrigerant and a second indirect heat exchanger for cooling vapors of the first portion of the refrigerant in an upper area of the distillation column using a cooled stream formed by expansion of the second portion of the refrigerant upon exiting the first indirect heat exchanger;

expanding the overhead stream to form a cooled contaminant-depleted stream; and introducing the cooled stream upon exiting the second indirect heat exchanger and the cooled contaminant-depleted stream back into the closed-loop refrigeration cycle.

2. The process of claim 1, wherein the refrigerant includes a hydrocarbon-containing refrigerant.

3. The process of claim 1, wherein the refrigerant is a pure component refrigerant.

4. The process of claim 1, wherein the refrigerant is a mixed refrigerant.

5. The process of claim 1, wherein the refrigerant comprises predominately propane.

6. The process of claim 1, wherein the refrigerant comprises predominately ethylene.

7. The process of claim 1, wherein the refrigerant comprises predominately methane.

8. The process of claim 1, wherein the facility employs cascade cooling to condense at least a portion of a natural gas feed stream.

* * * * *